US005329742A

United States Patent [19]

Lee

[11] Patent Number: 5,329,742

[45] Date of Patent: Jul. 19, 1994

[54] PROCESS FOR CONSTRUCTING A CONCRETE BUILDING

[76] Inventor: Wen-Yuan Lee, 7F-3, No. 8, Lane 390, Sec. 1, Chien-Kang Rd., Tainan City, Taiwan

[21] Appl. No.: 910,527

[22] Filed: Jul. 8, 1992

[51] Int. Cl.[5] ..... E04B 1/04

[52] U.S. Cl. ..... 52/743; 264/33; 264/34

[58] Field of Search ..... 264/33, 34; 249/152; 52/743

[56] References Cited

U.S. PATENT DOCUMENTS 3,275,719 9/1966 Dudson ..... 264/34
4,016,228 4/1977 Schmidt ..... 264/33
4,076,778 2/1978 Whitting ..... 264/33
4,650,150 3/1987 Pacheco-Pifano ..... 249/152
5,012,627 5/1991 Lundmark ..... 264/33

*Primary Examiner*—Carl D. Friedman
*Assistant Examiner*—Christopher Todd Kent
*Attorney, Agent, or Firm*—Joseph W. Berenato, III

[57] ABSTRACT

A method for constructing a concrete building having a plurality of stories in which walls and floors of the concrete building are formed by means of modular form assemblies which can be used repeatedly without disassembling and reassembling includes (a') forming concrete surrounding wall structures of the stories one after the other by elevating a modular inner form assembly to a level of each story from a level of a lower story until the concrete surrounding wall structure of an uppermost story is formed; and (b') forming floors of the stories one after the other by lowering a floor form assembly from the level of the uppermost story.

14 Claims, 10 Drawing Sheets

PROCESS FOR CONSTRUCTING A CONCRETE BUILDING

BACKGROUND OF THE INVENTION

1. Field of the Invention

This invention relates to a process for constructing a building, more particularly to a process for quickly constructing a concrete building which has a plurality of stories.

2. Description of the Related Art

When using a conventional constructing process to form concrete walls, form assembly is erected for concrete pouring and then is dismantled when the concrete walls have cured. When constructing concrete walls of a building, the form assembly is moved upwards for constructing concrete walls of an upper story after concrete walls of a lower story are constructed. Repeated erecting and dismantling of the form assembly for each story of the building is necessary, which costs much time and is not economical.

SUMMARY OF THE INVENTION

Therefore, the objective of this invention is to provide an improved process for quickly constructing a building. An erected form assembly can be lifted and lowered by an elevating means to form concrete walls of each story without repeated erecting and dismantling of said form assembly.

Accordingly, a process for constructing a concrete building having a plurality of stories includes the steps of (a) forming a base structure that constitutes at least one part of a first story; (b) mounting an elevating means on the base structure; (c) mounting a form support on the elevating means; (d) mounting a modular inner form assembly on the form support; (e) moving the form support to the level of an upper story immediately above the base structure by using the elevating means; (f) rigidly holding the form support with respect to the base structure; (g) setting up the modular inner form assembly in a molding position; (h) setting up an outer form assembly in a cooperative relationship with respect to the inner form assembly; (i) forming a concrete surrounding wall structure for the upper story using the inner and outer form assemblies; (j) releasing the inner and outer form assemblies from the formed concrete surrounding wall structure; (k) releasing the form support from the base structure and moving upward the form support to the level of a further upper story; (1) rigidly holding the form support with respect to the formed concrete surrounding wall structure of the upper story; and (m) moving the elevating means from the base structure to the formed concrete surrounding wall structure of the upper story on which the elevating means is then mounted. The constructing process includes repeating the step of (g) to the step of (m).

After forming a concrete surrounding wall structure of an uppermost story of the building, the constructing process further includes the steps of (n) lowering and positioning the form support to a concrete surrounding wall structure of a next lower story by the elevating means; (o) mounting a floor form assembly on the form support; (p) forming a concrete floor structure of the next lower story using the floor form assembly; (q) releasing the floor form assembly from the formed concrete floor structure; (r) releasing the form support from the concrete surrounding wall structure and lowering the form support to a further lower story; (s) rigidly holding the form support with respect to an another further lower story; and (t) lowering the elevating means to the level of the other further lower story on which the elevating means is then mounted. The constructing process further includes repeating the step of (p) to the step of (t).

BRIEF DESCRIPTION OF THE DRAWING

Other features and advantages of the present invention will become apparent in the following detailed description of the preferred embodiments, with reference to the accompanying drawings, of which.

DETAILED DESCRIPTION OF THE PREFERRED EMBODIMENT

Figure 1:
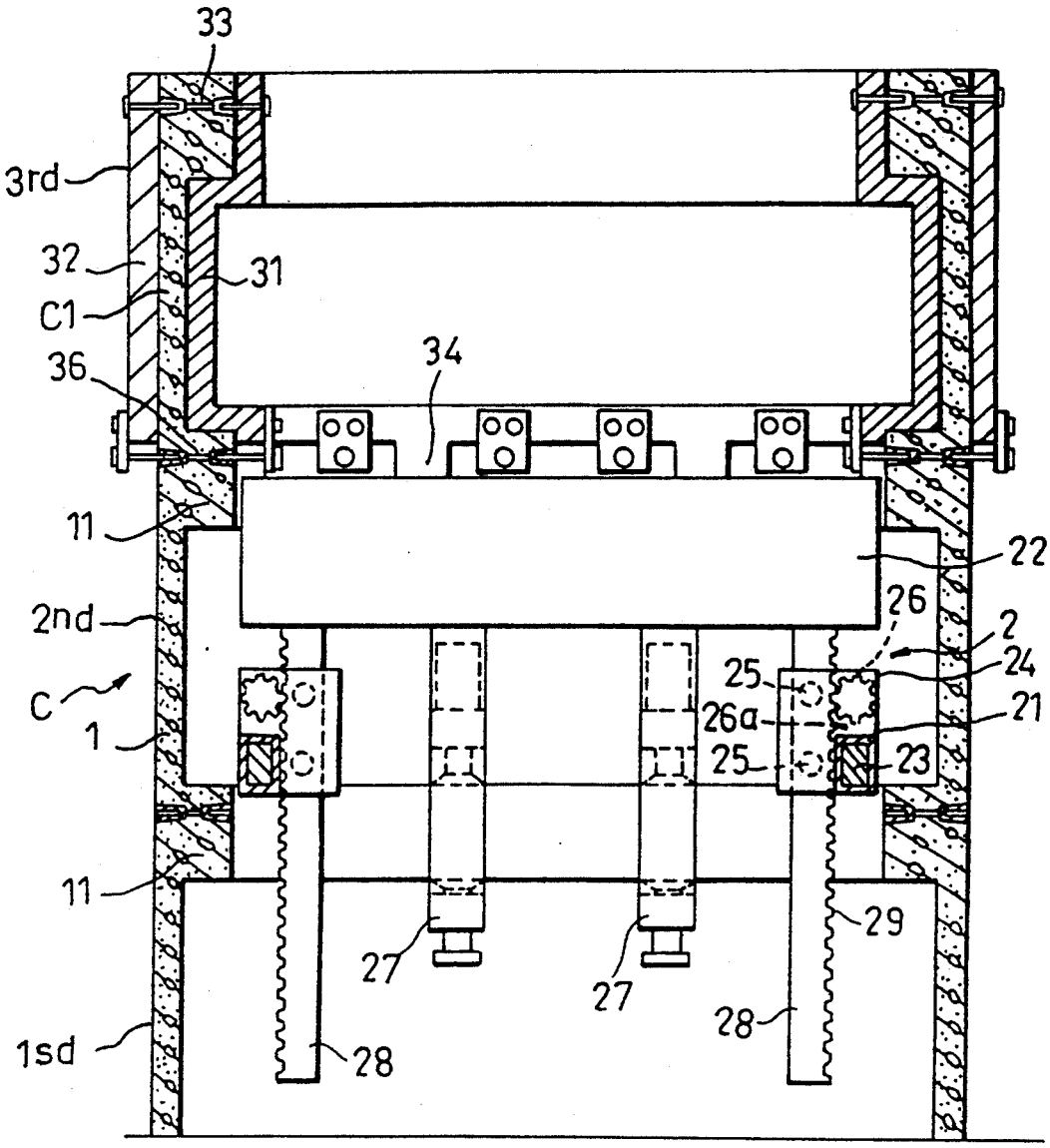
FIG. 1 is a schematic view showing construction of surrounding walls, structural beams and structural posts for a third floor of a building.
Figure 2:
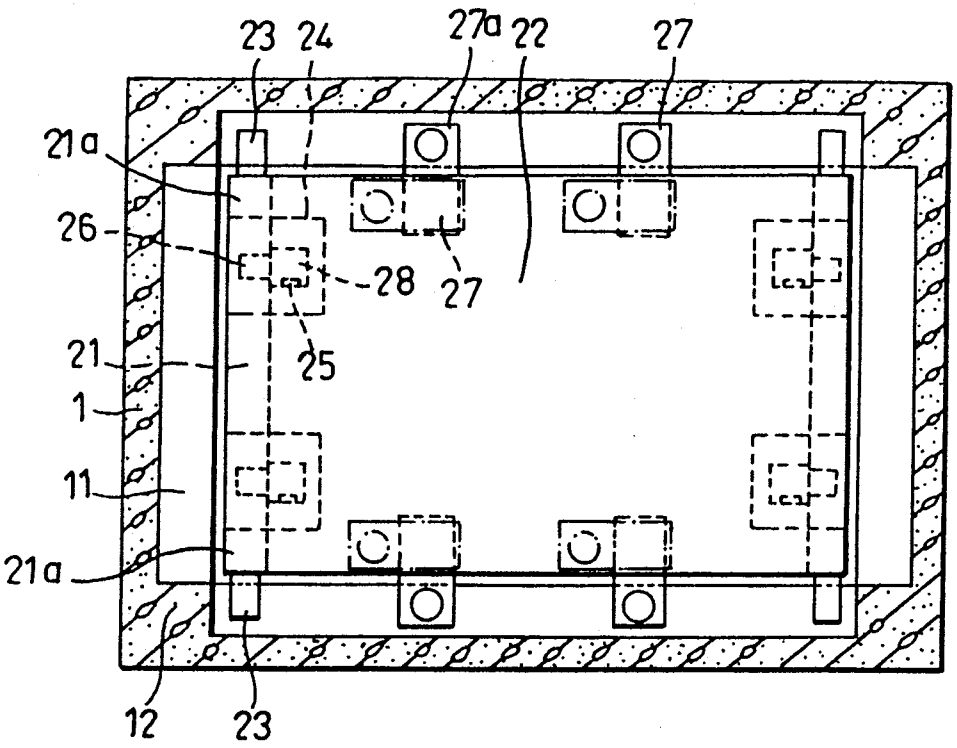
FIG. 2 is a top view showing the elevating means.
Figure 3:
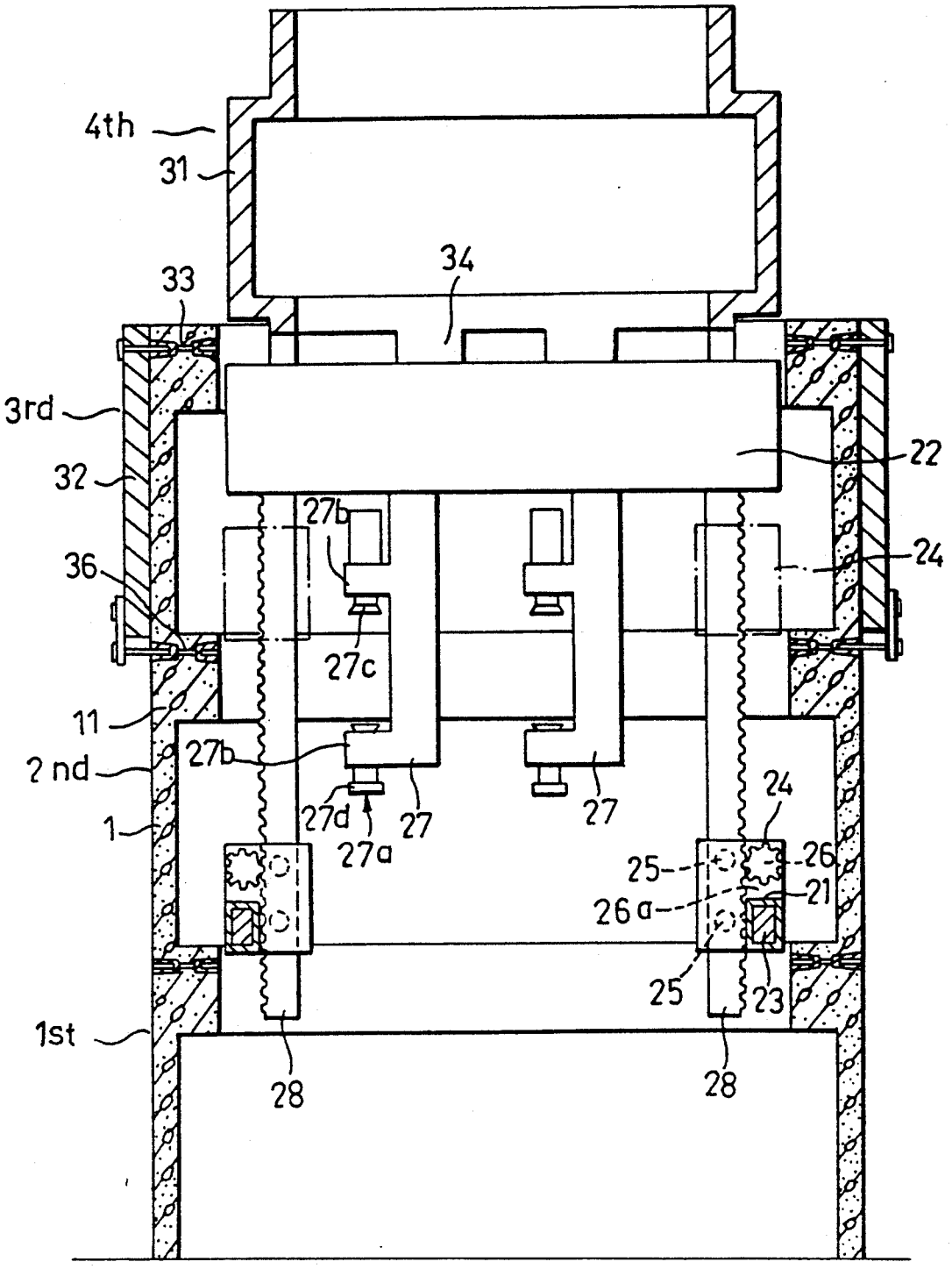
FIG. 3 shows the modular inner form assembly which has been released from the formed surrounding walls and which is moved upwards by the elevating means.

This embodiment relates to a building having ten stories. Referring to FIGS. 1 to 3, concrete surrounding wall structures (C) of first and second stories (1st, 2nd) of a building have been constructed by a conventional constructing process. The concrete surrounding wall structure (C) includes surrounding walls, horizontal structural beams (11) and vertical structural posts (12). A form support (22) is positioned on the level of the second story (2nd) by legs (27) extending downwardly and clamping units (27*a*) associated with the legs (27) to clamp releasably the structural beams (11) of the second story (2nd). The form support (22) can be a trussed frame and has high strength and low weight characteristics. Each leg (27) is pivotally connected to the form support (22) and has two seats (27*b*). Each leg (27) is turnable about a vertical axis between a mounting position in which the seat (27*b*) is shown in a solid line and a released position in which the seat (27*b*) is shown in a phantom line in FIG. 2. Each clamping unit (27*a*) is mounted on seats (27*b*) of the leg (27) and consists of a hydraulic operated clamp member (27*c*) associated with an adjustable fastener (27*d*). An elevating means (2) is mounted on the concrete surrounding wall structure (C) of the first story (1st). The elevating means (2) includes a pair of support bars (21), each of which is provided with a hydraulic operated retractable mounting member (23) on two ends (21*a*) thereof. The mounting members (23) are releasably positioned on the structural beams (11) of the first story (1st). Each support bar (21) has two seats (24) fixed thereon. Each seat (24) has a rack-and-pinion mechanism (26a) mounted therein and two rollers (25) mounted therein. The rack-and-pinion mechanism (26a) includes a pinion (26) and a rack (28). The rack (28) extends downwardly from the form support (22) and has a toothed face (29) to mesh with the pinion (26) and a longitudinal sliding groove for receiving the rollers (25) therein. A supporting frame (34) is mounted on the form support (22) to hold a modular inner form assembly (31) thereon. The modular inner form assembly (31) is set up in a molding position. A modular outer form assembly (32) is set up in a cooperative relationship with respect to the modular inner form assembly (31). An upper connecting means (33) and a lower connecting means (36) are provided to fasten the inner and outer form assemblies (31, 32). Concrete is poured between the inner and outer form assemblies (31, 32) so as to form a concrete surrounding wall structure (C1) of a third story (3rd). The concrete surrounding wall structure (C1) includes surrounding walls (1), structural beams (11) and structural posts (12). After the formed concrete surrounding wall structure (C1) has cured, the inner form assembly (31) is stripped from it. In FIG. 3, the clamping units (27a) are released from the structural beams (11) and each leg (27) is turned to a position shown by a phantom line in FIG. 2 so as to move upward the form support (22) to the level of the third story (3rd) by the rack-and-pinion mechanisms (26a). The form support (22) is rigidly held with respect to the structural beams (11) of the second story (2nd) by positioning the legs (27) in the mounting position and clamping the structural beams (11) with the clamping units (27a). The inner form assembly (31) is set up again in a molding position. The outer form assembly (32) is released from the formed concrete surrounding wall structure (C1) of the third story (3rd) and is moved to the level of the fourth story (4th). The outer form assembly (32) is set up again and cooperates with the inner form assembly (31) for forming a concrete surrounding wall structure for the fourth story (4th). The length of the rack (28) is substantially equal to the height of two stories. After the concrete surrounding wall structure (C1) of the fourth story is formed, the support bars (21) are released from the structural beams (11) of the first story (1st) by retracting the mounting members (23). The support bars (21) associated with the seats (24) are moved upward to the level of the second story (2nd), shown by a phantom line in FIG. 3, by the rack-and-pinion mechanisms (26a) and are then positioned on the structural beams (11) of the second story (2nd) by the mounting members (23). Afterwards, the clamping units (27a) are released from the structural beams (11) and the form support (22) is further moved upward to the level of a fifth story for forming a concrete surrounding wall structure of the fifth story. Therefore, by repeating the above described process, the concrete surrounding wall structure of an upper story can be formed after the concrete surrounding wall structure of a lower story is formed. Finally, the concrete surrounding wall structure of an uppermost story of this building is formed.

Like elements are indicated by the same reference numerals throughout the disclosure.

Figure 4:
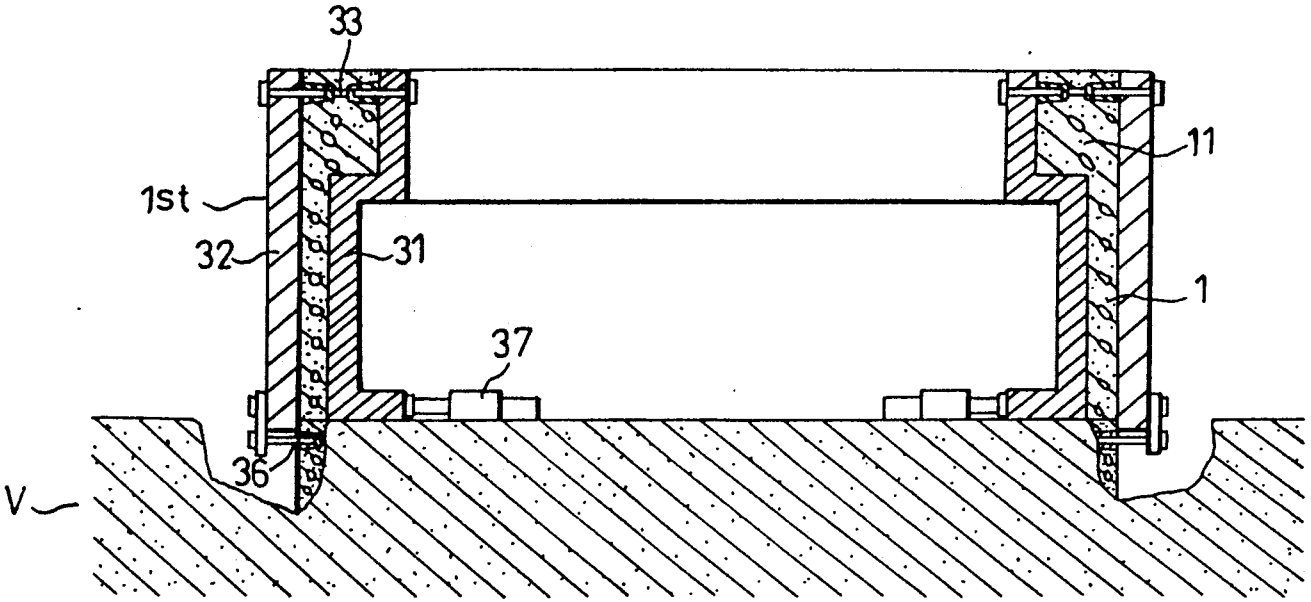
FIG. 4 is a schematic view showing the construction of concrete walls of a first floor of the building by a conventional process.
Figure 5:
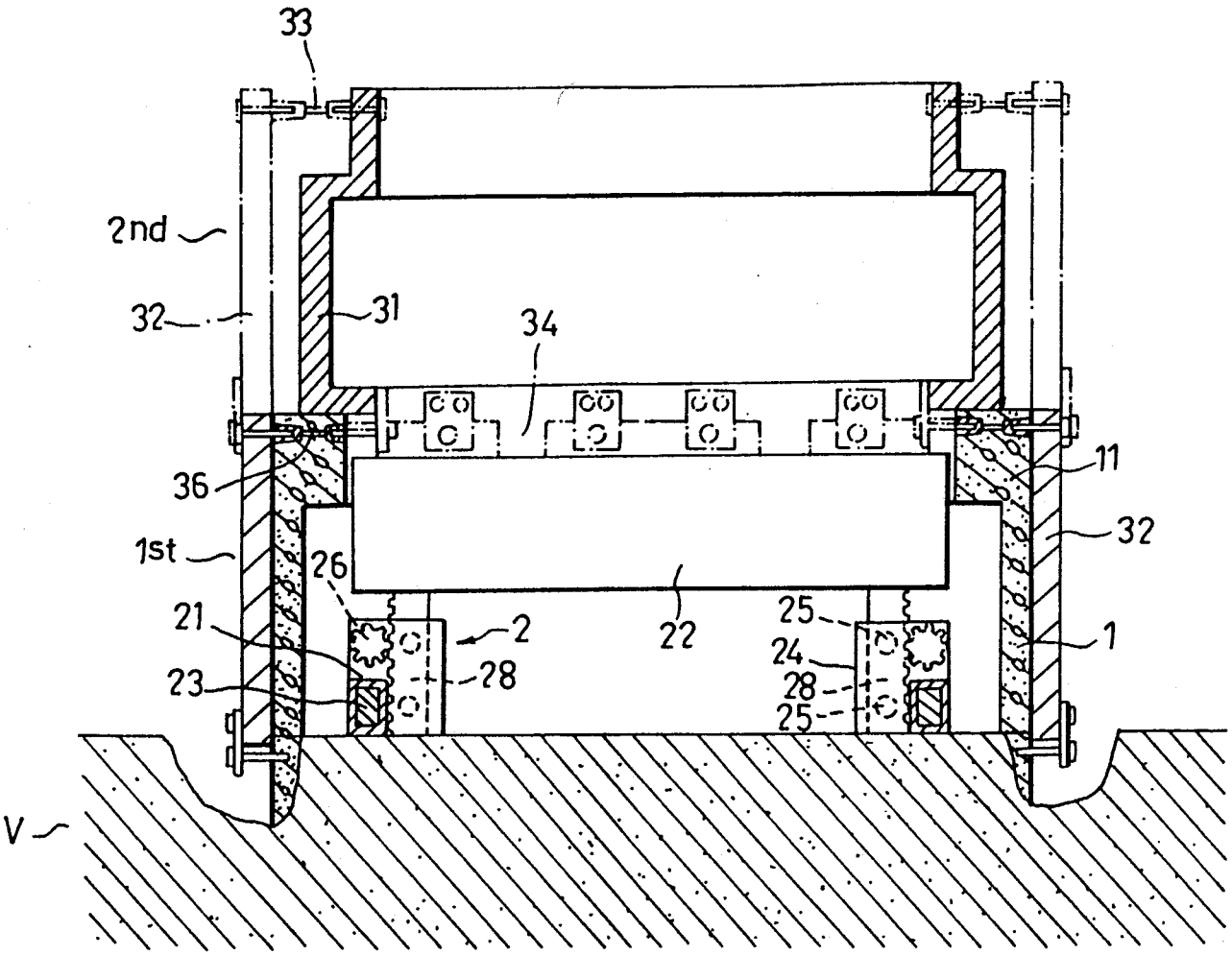
FIGS. 5 and 6 show how to mount the elevating means onto the building.
Figure 6:
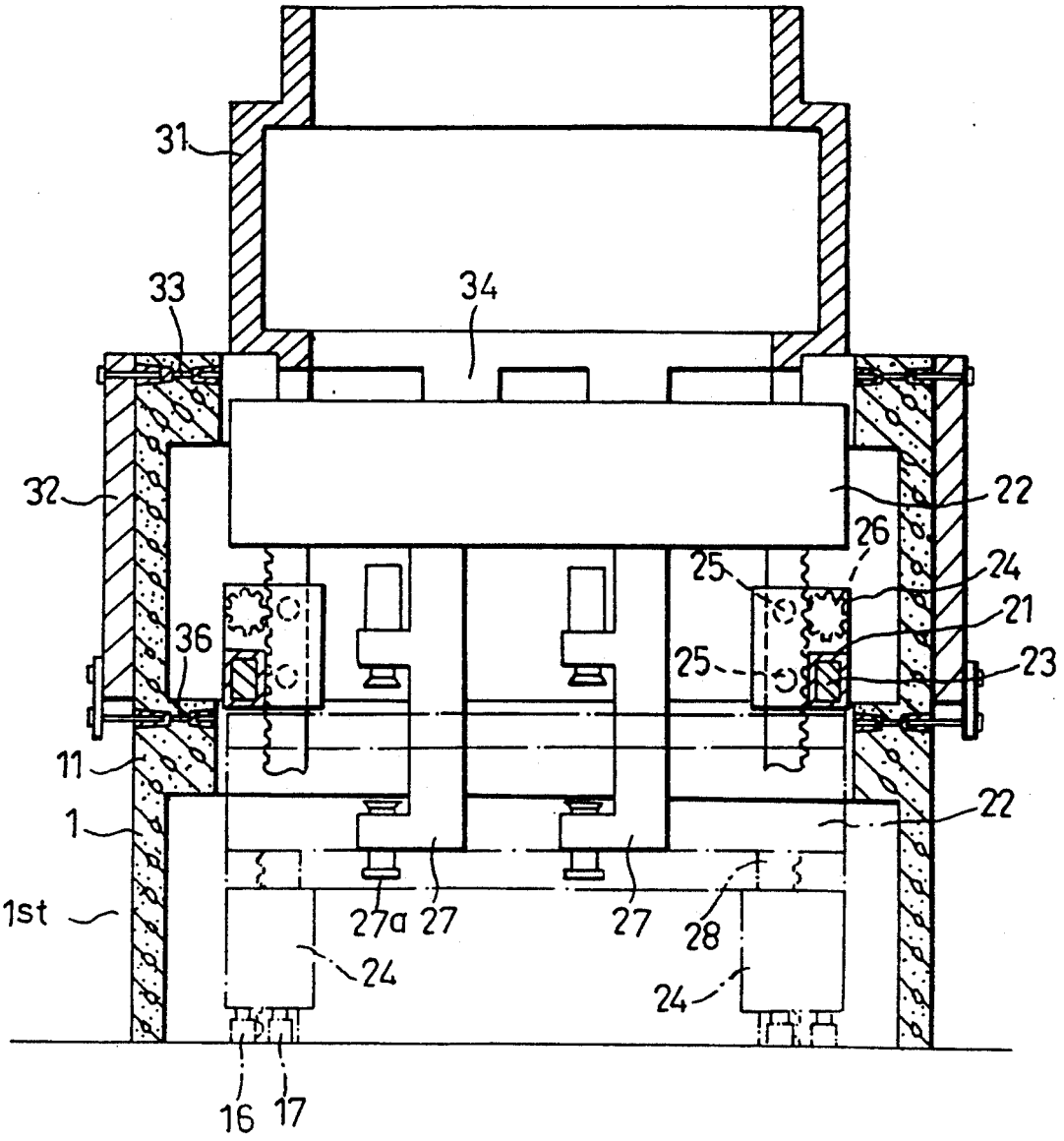

FIG. 4 shows the construction of the first story (1st) using the modular inner and outer form assemblies (31, 32) of this invention. The modular inner and outer form assemblies (31, 32) are set up above a floor (V) of a basement by the connecting means (33, 36) and a mold supporting and mold releasing apparatus (37) for forming a concrete surrounding wall structure (C) of the first story (1st). FIGS. 5 and 6 teach the construction of the second story by the constructing process of this invention and the mounting of the elevating means (2). Referring to FIG. 5, the form support (22) is positioned on the level of the first story (1st) by the elevating means (2) mounted on the floor (V) of the basement. The modular inner form assembly (31) is supported on the form support (22) and is set up in a molding position. The outer form assembly (32) can be moved to the level of the second story (2nd) and is set up in a molding position for concrete pouring. The concrete surrounding wall structure of the second story is thus formed. Referring to FIG. 6, a jack means (16) is provided under each seat (24) and a jack means (17) is provided under each rack (28). The elevating means (2) is lifted to the level of the first story (1st) by the operation of the jack means (16, 17). The retractable mounting members (23) are positioned on the structural beams (11) of the first story (1st) as previously described. The length of each rack (28) can then be added until the rack (28) has the length equal to the height of two stories. Afterwards, the legs (27) associate with clamping units (27a) are mounted to the form support (22) for releasably clamping the structural beams (11).

Figure 7:
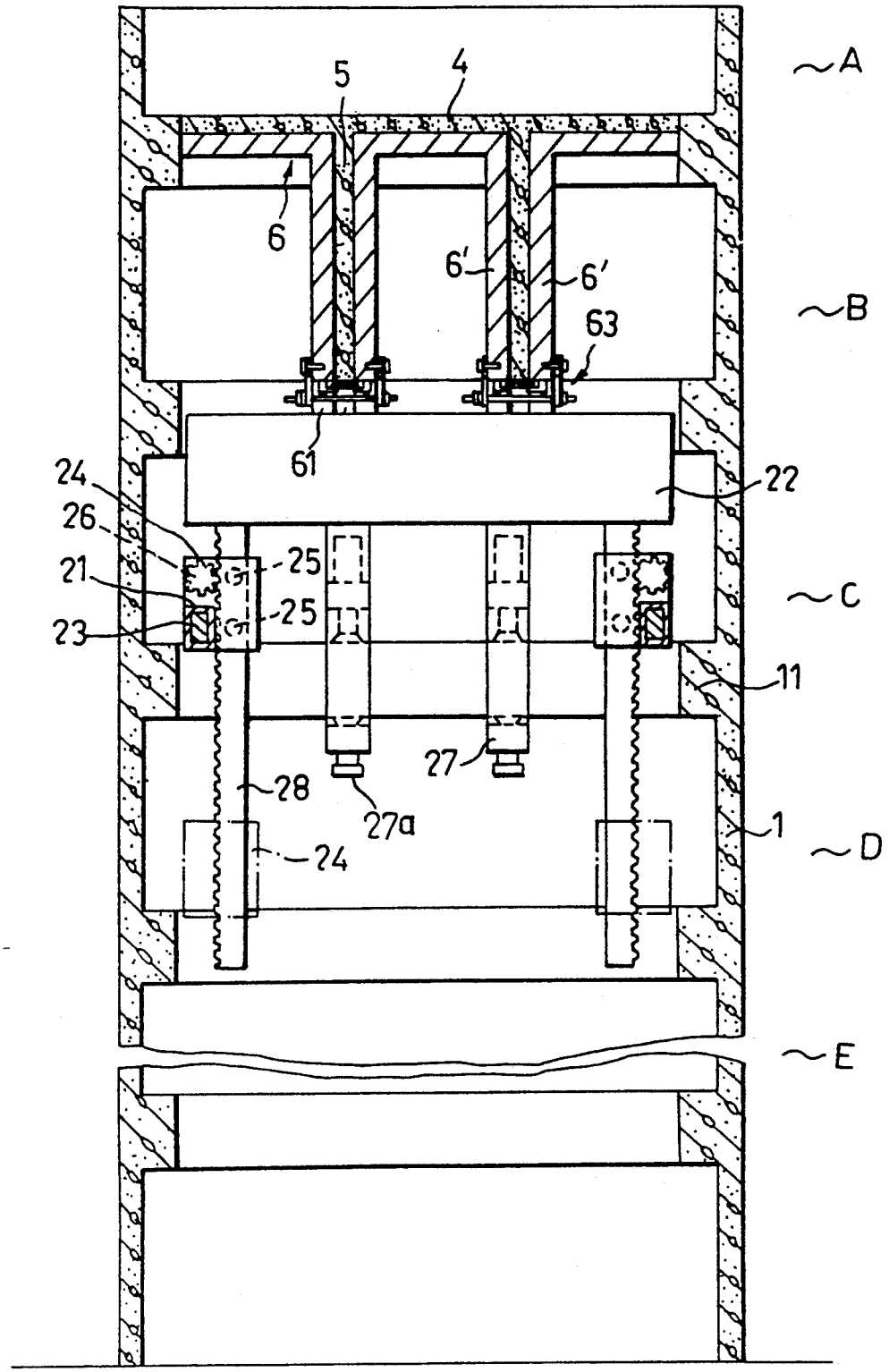
FIG. 7 is a schematic view showing the construction of the floor and partition walls.
Figure 8:
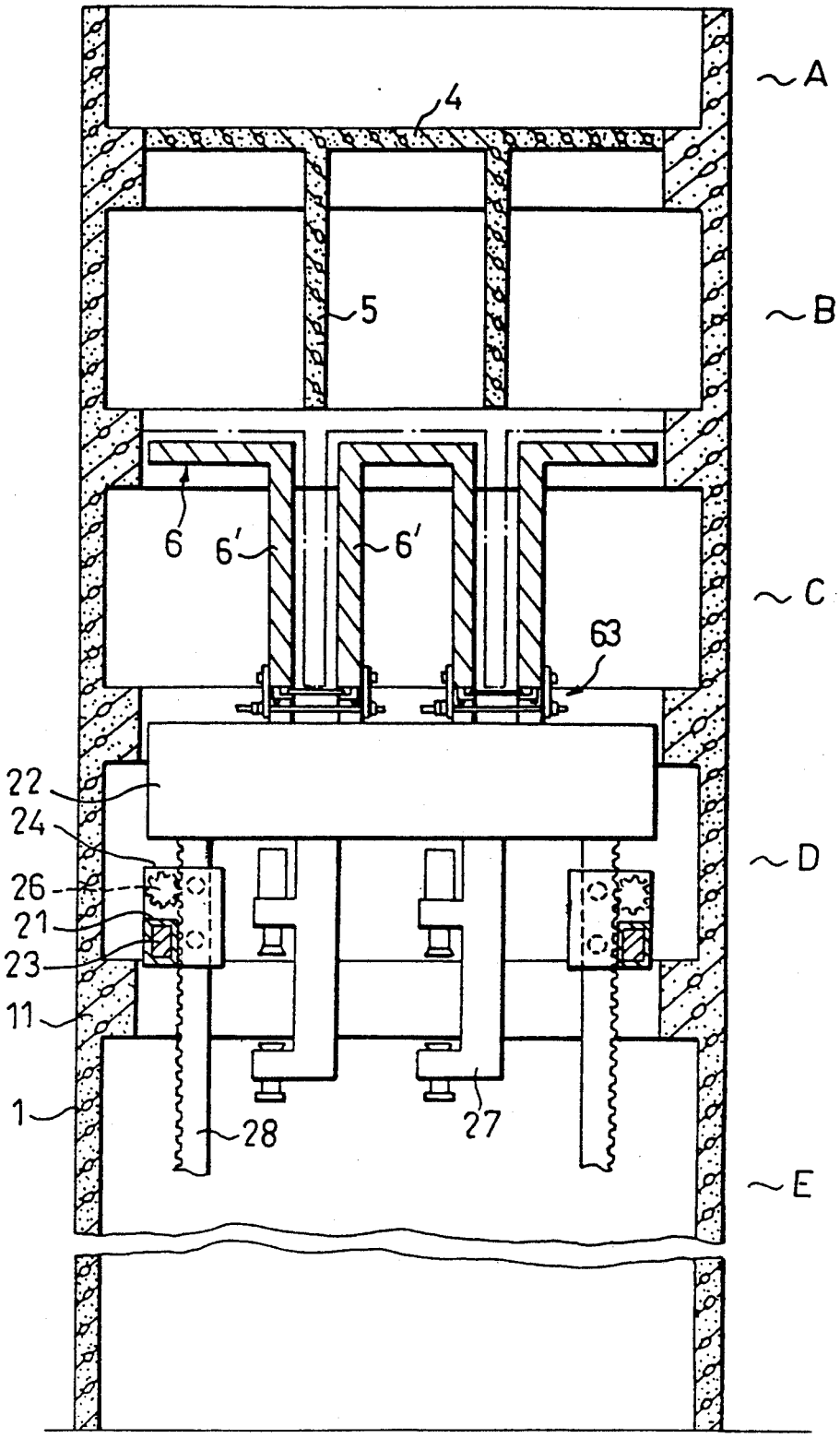
FIG. 8 shows the movement of the floor form assembly downward by the elevating means.
Figure 9:
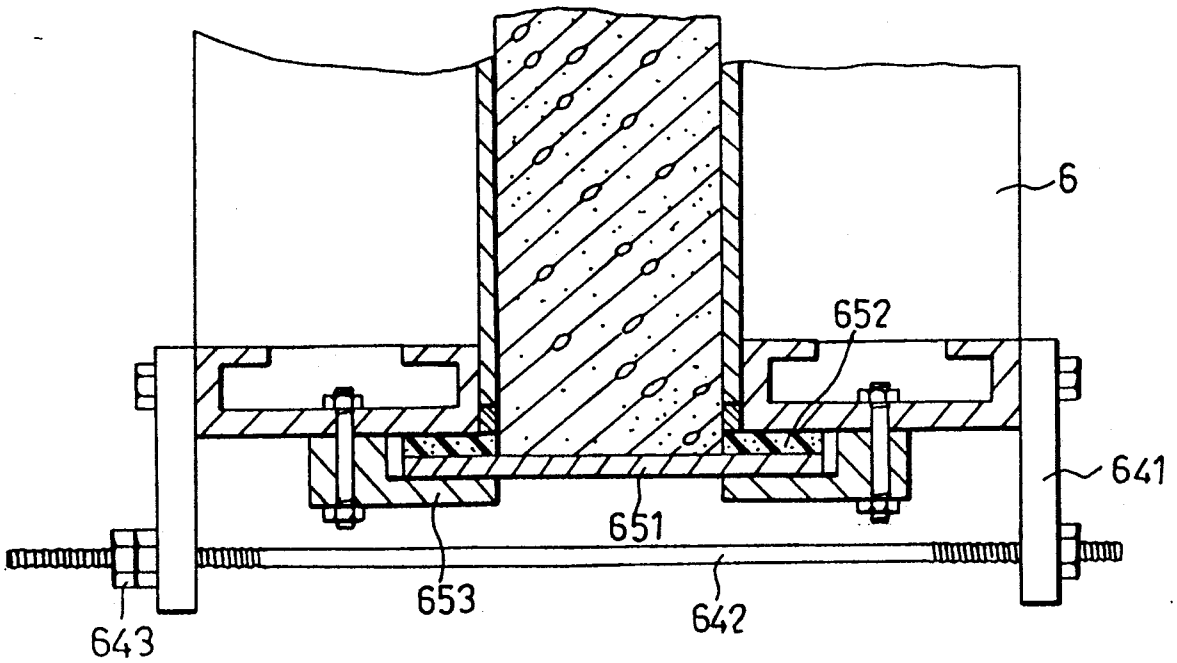
FIG. 9 is a schematic view of a connecting means.

Referring to FIGS. 7 and 9, after forming the concrete surrounding wall structure of a rooftop (A) of the building, the form support (22) is lowered to the level of the ninth story (C) by the elevating means (2) and is positioned on the ninth story (C) by the clamping units (27a). A supporting frame (61) is mounted on the form support (22) to hold a floor form assembly (6) thereon. The floor form assembly (6) includes a form assembly (6') which forms partition walls. The floor form assembly (6) is provided with a combined connecting and covering means (63) to prevent the leakage and to bear the pressure of the pouring concrete. The floor form assembly (6) is set up in a molding position, and then a floor (4) and partition walls (5) are formed by pouring concrete into the floor form assembly (6). Referring to FIG. 8, after the concrete has cured, the floor form assembly (6) is stripped from the formed floor (4) and partition walls (5). The form support (22) is lowered and positioned on the level of the eighth story (D) by the elevating means (2) and clamping units (27a) for the construction of the floor and partition walls of the ninth story (C). The above operations are repeated to form the floors and partition walls of the building from the second story. The floor and partition walls of the first story is formed in a conventional way.

Figure 10:
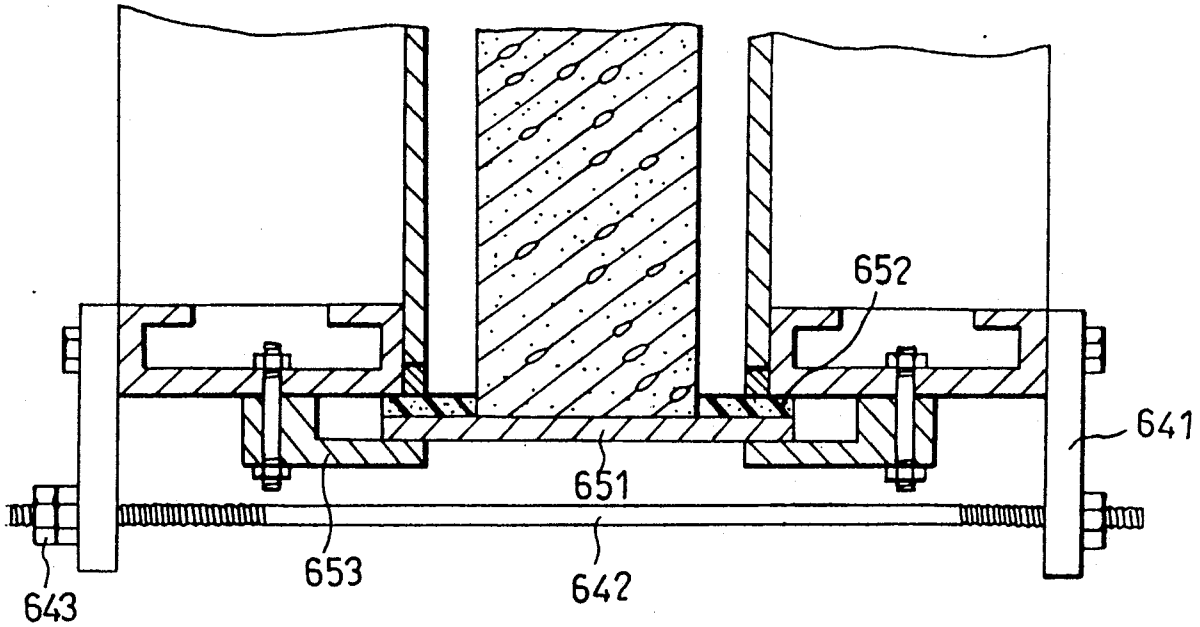
FIG. 10 is a schematic view of the connecting means in FIG. 9 when the floor form assembly is released from the formed floor and partition walls.

Referring to FIG. 9, the combined connecting and covering means (63) includes two connecting members (641) fixed to the floor form assembly (6) by screws, a rod (642) connected to the connecting members (641) by screws (643), a bearing and covering board (651) and two seats (653) connected to the floor form assembly (6) to retain the board (651). Two elastic members (652) are provided between the floor form assembly (6) and the board (651). Referring to FIG. 10, the combined connecting and covering means (63) are operated to release the floor form assembly (6) from the formed floor and partition walls (4, 5).

The modular inner form assembly (31) for the concrete surrounding wall structure (C) and the floor form assembly (6) for the floor and partition walls can be used repeatedly without disassembling and reassembling. Thus the concrete walls of each story of the building can be quickly constructed. Thus, it is economical in terms of time. Since the floor and partition walls are formed one after the other by lowering the floor form assembly (6) from the level of the uppermost story, the construction of walls can be continued no matter whether what the weather.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A method of constructing a concrete building, comprising the steps of:

a) forming a base structure providing a lowermost floor for a building;

b) providing an inner form having an upper vertically extending form portion disposed inward of an integral lower vertically extending form portion, a horizontal beam forming portion, and a vertical post forming portion so that the resulting horizontally extending beam is thicker than the vertical wall portion;

c) providing an outer form;

d) positioning on the base structure the inner and outer forms in juxtaposition for therebetween defining a concrete receiving chamber;

e) filling the chamber with concrete;

f) curing the concrete;

g) stripping the forms from the cured concrete and thereby exposing a first integral concrete wall, beam, and post providing at least a portion of a first floor of the building;

h) providing a jack assembly and a clamp assembly, each assembly operatively secured to the inner form;

i) elevating the inner form by operating the jack assembly;

j) clamping the clamp assembly to the horizontal beam and thereby positioning the inner form at a selected position; and k) positioning the outer form relative to the inner form and thereby defining another concrete receiving chamber.

2. The method of claim 1, further including the step of:

repeating step e through step k for each floor of the building.

3. The method of claim 2, further including the steps of:

a) lowering the inner form by operating the jack assembly;

b) clamping the clamp assembly to a horizontal beam and thereby positioning the inner form at a selected position;

c) providing a floor form assembly having vertical partition wall forming portions and integral horizontal floor forming portions defining vertical partition wall chambers and an integral floor chamber;

d) filling the vertical partition wall and integral floor forming chambers with concrete;

e) curing the concrete; and f) stripping the forms from the cured concrete.

4. The method of claim 3 including the step of:

repeating step a through f for each floor of the building.

5. The method of claim 1 including the steps of:

a) providing a jack assembly and a clamp assembly having a supporting bar provided with a retractable mounting member to be releasably positioned on the concrete surrounding wall; and b) providing a rack and pinion mechanism mounted on the supporting bar.

6. The method of claim 1, further including the step of:

providing a concrete receiving chamber defining the outer periphery of a building.

7. The method of claim 1, further including the step of:

providing a jack assembly extending vertically downward from the inner form.

8. The method of claim 1, further including the step of:

providing a clamp assembly extending vertically downward from the inner form.

9. The method of claim 1 further including the step of:

providing a form support operatively disposed between the concrete receiving chamber and the jack assembly and the clamp assembly.

10. The method of claim 8 further including the step of:

providing a clamp assembly having a plurality of vertically disposed oppositely facing clamping members.

11. The method of claim 9 further including the step of:

providing a clamp assembly rotatably secured to the inner form.

12. The method of claim 1, further including the step of:

contracting the inner form beyond the horizontal beam.

13. A method of constructing a concrete building, comprising the steps of:

a) forming a base structure providing a lowermost floor for a building;

b) providing an inner form having a vertical wall forming portion, a horizontal beam forming portion, and a vertical post forming portion;

c) providing an outer form;

d) positioning on the base structure the inner and outer forms in juxtaposition for therebetween defining a concrete receiving chamber;

e) filling the chamber with concrete;

f) curing the concrete;

g) stripping the forms from the cured concrete and thereby exposing a first integral concrete wall, beam, and post providing at least a portion of a first floor of the building;

h) providing a jack assembly extending vertically downward from the inner form and a clamp assembly, each assembly operatively secured to the inner form;

i) elevating the inner form by operating the jack assembly;

j) clamping the clamp assembly to the horizontal beam and thereby positioning the inner form at a selected position; and k) positioning the outer form relative to the inner form and thereby defining another concrete receiving chamber.

14. A method of constructing a concrete building comprising the steps of:

a) forming a base structure providing a lowermost floor for a building;

b) providing an inner form having a vertical wall forming portion, a horizontal beam forming portion, and a vertical post forming portion;

c) providing an outer form;

d) positioning on the base structure the inner and outer forms in juxtaposition for therebetween defining a concrete receiving chamber;

e) filling the chamber with concrete;

f) curing the concrete;

g) stripping the forms from the cured concrete and thereby exposing a first integral concrete wall, beam, and post providing at least a portion of a first floor of the building;

h) providing a jack assembly and a clamp assembly extending vertically downward from the inner form, each assembly operatively secured to the inner form;

i) elevating the inner form by operating the jack assembly;

j) clamping the clamp assembly to the horizontal beam and thereby positioning the inner form at a selected position;

k) positioning the outer form relative to the inner form and thereby defining another concrete receiving chamber.

* * * * *